United States Patent [19]

Dethlefsen

[11] 4,272,661

[45] Jun. 9, 1981

[54] HIGH SPEED VACUUM INTERRUPTER

[75] Inventor: Rolf Dethlefsen, Greensburg, Pa.

[73] Assignee: Gould Inc., Rolling Meadows, Ill.

[21] Appl. No.: 884,984

[22] Filed: Mar. 9, 1978

[51] Int. Cl.[3] ..... H01H 33/66; H01H 53/00

[52] U.S. Cl. ..... 200/144 B; 335/147

[58] Field of Search ..... 200/144 B; 335/261, 335/262, 268, 277; 337/19, 147

[56] References Cited

U.S. PATENT DOCUMENTS

| | | | |
|---|---|---|---|
| 2,930,870 | 3/1960 | Baer | 335/147 |
| 2,966,569 | 12/1960 | Jennings | 200/144 B |
| 3,268,687 | 8/1966 | Waghorne et al. | 200/144 B X |
| 3,471,814 | 10/1969 | Burdett | 200/144 B X |
| 3,501,724 | 3/1970 | Westphal | 335/277 X |
| 3,612,939 | 10/1971 | Rabinowitz | 200/144 B X |
| 3,944,771 | 3/1976 | Kohler | 200/144 B |
| 4,079,217 | 3/1978 | Oeschger | 200/144 B |
| 4,130,781 | 12/1978 | Dethlefson | 200/144 B X |

*Primary Examiner*—James R. Scott

*Attorney, Agent, or Firm*—Ostrolenk, Faber, Gerb & Soffen

[57] ABSTRACT

An electrodynamic operating mechanism is connected to a vacuum interrupter to produce an interrupter with a switching time of about one millisecond. Magnetic latch means are provided to hold the contacts open after interrupter operation.

16 Claims, 3 Drawing Figures

HIGH SPEED VACUUM INTERRUPTER

BACKGROUND OF THE INVENTION

This invention relates to circuit interrupters, and more specifically relates to a high-speed vacuum interrupter which can attain switching times of less than one millisecond. There are many applications which require extremely high speed interruption of a circuit. As one example of such applications, a very high speed interrupter is useful in fault current-limiting interrupters in which high speed contacts are opened to commutate main circuit current into current-limiting devices. In general, the vacuum interrupter is opened synchronously a short time before the circuit produces a current zero. The short arcing time reduces contact erosion and allows the interruption of high power levels. The arcing time preferably is somewhat less than one millisecond. Many other applications for extremely high speed interrupters exist.

Vacuum interrupters are well known and use the high dielectric strength of a vacuum to interrupt circuits with a relatively small interrupting gap. In the past, the high speed recovery characteristics of the vacuum have produced current chopping and this has been an undesirable characteristic of the vacuum interrupter.

BRIEF DESCRIPTION OF THE INVENTION

The present invention takes advantage of the high values of current chopping which can be obtained with a vacuum interrupter, and enhances the operating time of the interrupter by providing a Lenz coil operator, or electrodynamic operating mechanism, to separate the contacts at extremely high speed. The movable components are designed to have minimum mass, and the contact separation is limited to a small gap, for example, 5 millimeters. The electrodynamic operating mechanism is particularly well suited to operate over this relatively short stroke. Thus, exceptionally high operating speed is obtained, which can produce fast switching times near one millisecond. Each interrupter can have a dielectric withstand of the order of 50 kV, and higher voltages can be attained by the series connection of identical devices which are simultaneously operated by a suitable control circuit.

The electrodynamic operating mechanism may use a movable short-circuited coil for moving the vacuum interrupter contact. This coil may also serve as a piston which can be magnetically latched open to hold the interrupter open. A bellows or diaphragm seal, suitable for high speed operation, is also provided. The atmospheric force exerted on this flexible seal can be used for reclosing the interrupter.

The resulting device is simple in construction and is relatively inexpensive. The interrupter will also have a long operating life.

DETAILED DESCRIPTION OF THE DRAWINGS

Figure 1:
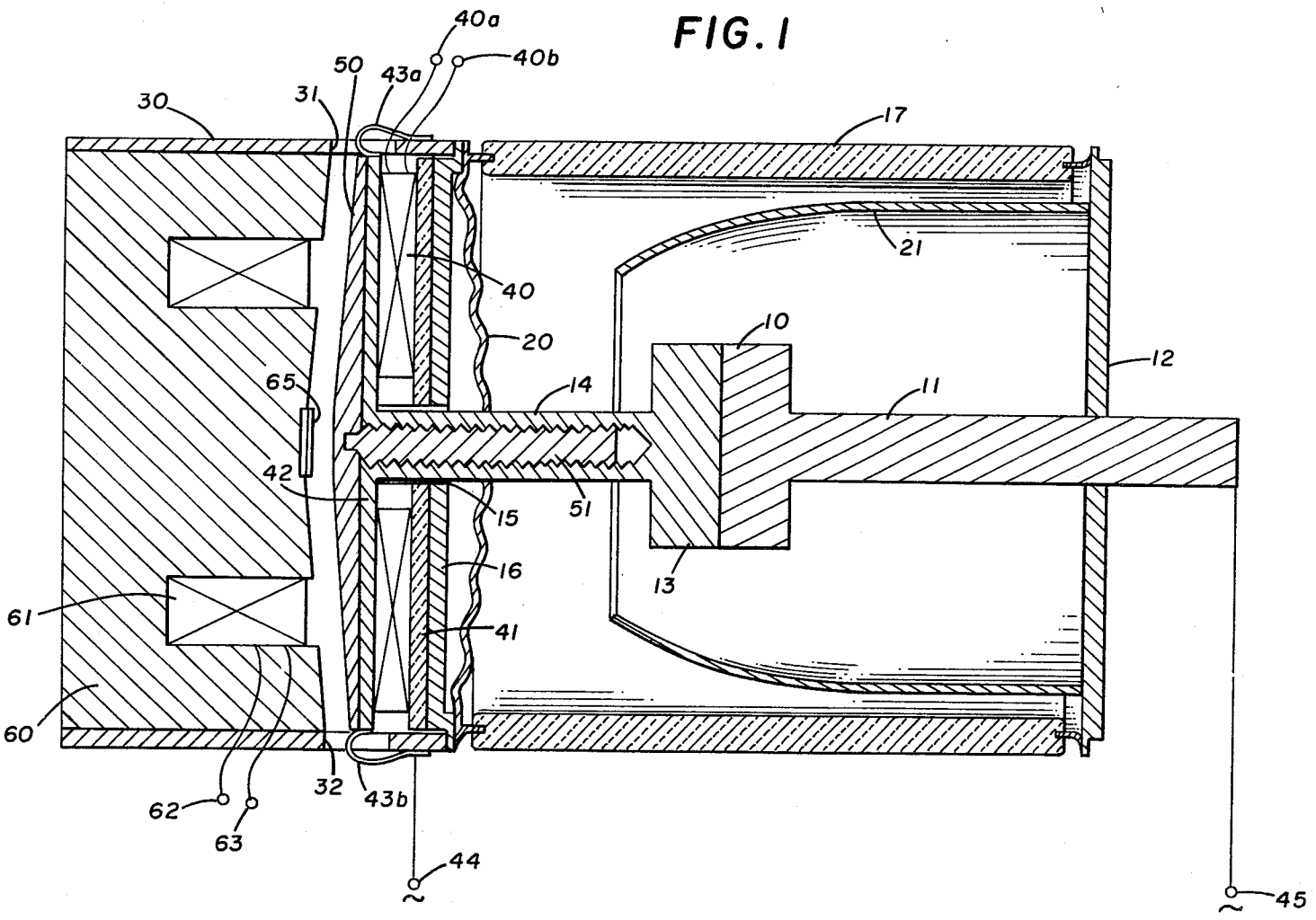
FIG. 1 is a cross-sectional view of a first embodiment of the present invention.

Referring first to FIG. 1, there is shown a cross-sectional view, through the axis of an interrupter which is generally cylindrical in section. The vacuum interrupter includes a fixed contact 10 carried on terminal conductor 11 which extends through conductive end plate 12. A movable contact 13, shown in engagement with contact 10, is then carried on conductive shaft 14 which extends through a cricular opening 15 in the other conductive end plate 16. Contacts 10 and 13 may be of materials such as copper, iron or tungsten which may display a high level of current chopping.

End plates 12 and 16 are suitably fixed to the ends of a ceramic or glass or other insulation tube 17, as well known in the art, and the interior of tube 17 is evacuated. A flexible metal diaphragm 20 is sealed between end plate 16 and enclosure 17, and is also sealed to movable shaft 14 to permit manufacture of a vacuum-tight structure while permitting a relatively small movement. For example, if diaphragm 20 has a diameter of 15 centimeters, movement of shaft 14 and movable contact 13 is easily obtained.

An arc shield 21 encloses the region between contacts 10 and 13 to prevent splatter of material on the inner wall of tube 17 during arc interruption operation. Note that shield 21 is fixed to end plate 12 in FIG. 1 while it is fixed to plate 16 in FIG. 2.

A tubular extension 30 is fixed to plate 16 and is provided with peripheral openings, such as openings 31 and 32, which provide feed-through area for flexible current connections which will be later described.

A Lenz coil 40, which may be a coil having, for example, ten spirally wound turns, is then fixed on an insulation plate 41 which is, in turn, fixed to end plate 16. Current is applied to coil 40 at terminals **40*a* and 40*b*** which can be connected to a stored charge capacitor type circuit when circuit interruption is desired.

The movable coil, which cooperates with Lenz coil 40, consists of annular-shaped conductive counterplate 42 which is fixed to and may be integral with movable shaft 14.

Counterplate 42 may be of aluminum or copper, and the surface of counterplate 42 facing coil 40 may be silver-plated for better conductivity. Several flexible current-carrying braids **43*a* and 43*b* extend through openings 31 and 32, and are used to connect plate 42 to one device terminal 44. The other device terminal 45 is connected to conductive member 11. Annular conductive counterplate 42 is provided with a high-strength steel reinforcement plate 50 which can have an extension, or a separate bolt section, 51 threaded into extension 14**.

An electromagnetic latch structure consisting of a magnetic core 60 and coil 61 are then provided, whereby a d-c sealing current is applied to terminals 62 and 63 of coil 61 as needed. Alternatively, a permanent magnet could be provided with a suitable mechanical impulse release means to defeat magnetic latching when desired. An insert of suitable shock-absorbing material 65 is also provided on the center of core 60.

The operation of the device of FIG. 1 is as follows:

When it is desired to open the interrupter, a high current is caused to flow in Lenz coil 40. This can be obtained by discharging a charged capacitor into the coil 40 upon a suitable opening command. The high rate of change of current in coil 40 will then induce a high circulating current in the counterplate 42, which is a short-circuited coil very closely coupled to coil 40. A very high repulsion force is then created between coil 40 and counterplate 42 which drives counterplate 42 to the left until the steel reinforcing plate 50 strikes the shock-absorber 65.

When the steel plate 50 reaches the core 60, a current in coil 61 will tend to establish a magnetic field in plate 50 which holds the plate to the left, and holds the contacts 10 and 13 open. In order to reclose the interrupter, the current in coil 61 is interrupted, and the atmospheric pressure on the left of diaphragm 20 will drive the movable assembly closed.

In the device operation, a relatively small contact movement, about 5 millimeters, is used and the movable parts are relatively light and simple in structure. Thus, extremely high speed operation is possible.

Figure 2:
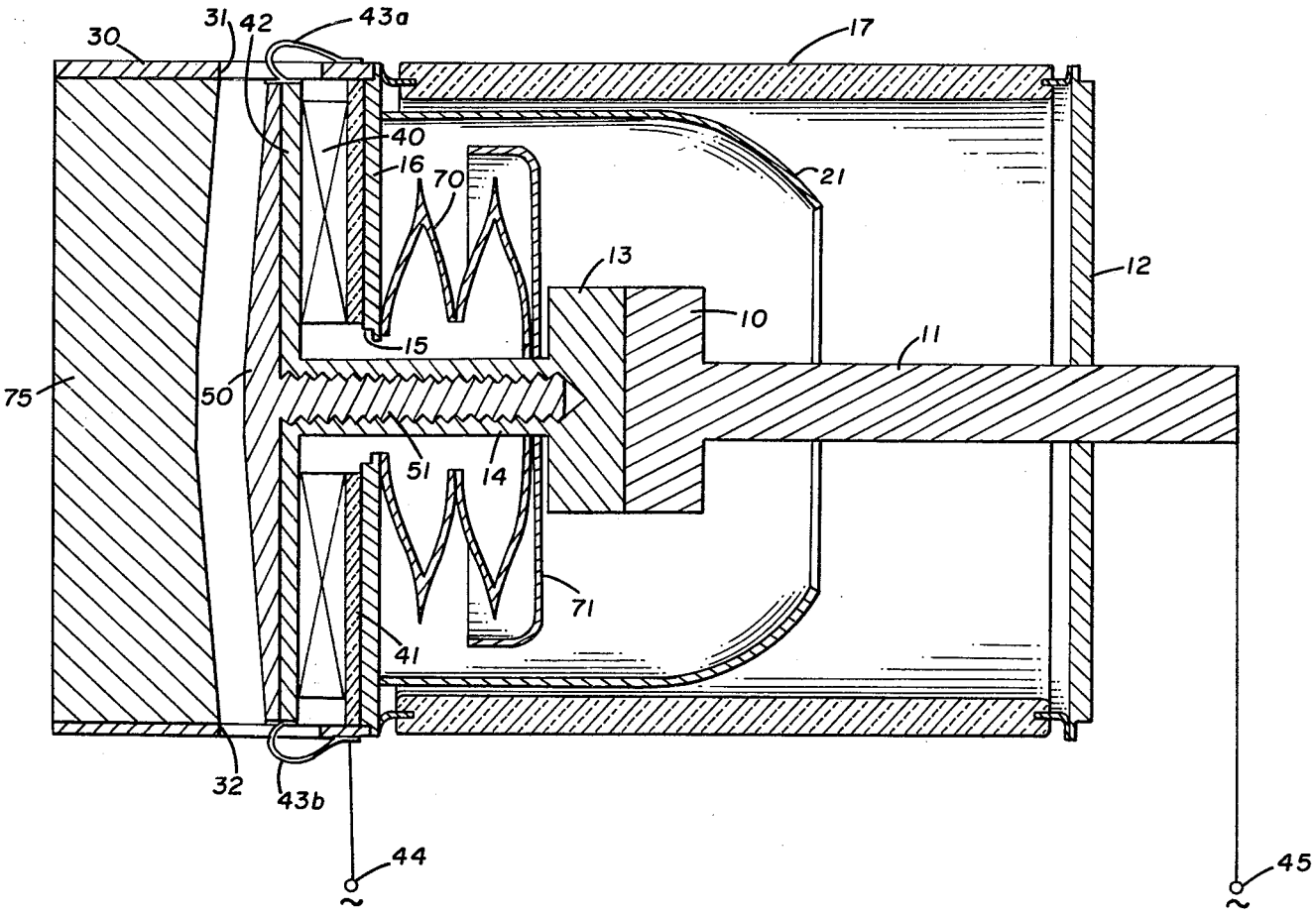
FIG. 2 is a cross-sectional view of a second embodiment of the invention.

FIG. 2 shows a second embodiment of the invention where components similar to those of FIG. 1 are given the same identifying numerals.

FIG. 2 shows the use of a welded bellows 70 in place of the diaphragm 20 of FIG. 1. A short shield 71 is provided to protect bellows 70 from arcing products. Arc shield 21 is then fastened to plate 60 and the contact sleeve 14 may then be kept shorter than in FIG. 1.

A further change in the embodiment of FIG. 2 is that the tube 30 is filled with a shock-absorbing mass 75. Thus, the contacts 10 and 13 will automatically reclose after opening under the action of the recoil from shock-absorber 75, atmospheric pressure, and the force exerted by bellows 70. Thus, if the interrupter is required to be open for only a short time, say 5 milliseconds, after opening, the arrangement of FIG. 2 can be used.

In FIGS. 1 and 2, only one contact of the pair of contacts is shown to be movable. If a larger contact stroke is desired, both contacts 10 and 13 can be made movable with bellows or diaphragms and Lenz coil operators at both ends of the device.

In general, in the structures of FIGS. 1 and 2, the high dielectric strength vacuum allows a very short contact gap. This makes the Lenz coil actuator particularly useful in combination with a vacuum interrupter since the Lenz coil actuator provides high impulse forces over a short stroke. The use of atmospheric forces for reclosing the interrupter also substantially simplifies the system.

In the embodiment of FIGS. 1 and 2, there is preferably a small gap, for example, about 1 mm between Lenz coil 40 and its counterplate 42. This gap is used to allow contact pressure to be maintained between contacts 10 and 13 when they are in the closed position even though there may be some contact erosion due to repeated operation of the interrupter. The initial gap between Lenz coil 42 and counterplate 40, however, reduces the contact opening force and therefore should be kept small and is thus limited to small adjustment. As will be seen, the embodiment of FIG. 3 permits larger adjustment for contact erosion but permits close coupling of the Lenz coil and its counterplate.

Figure 3:
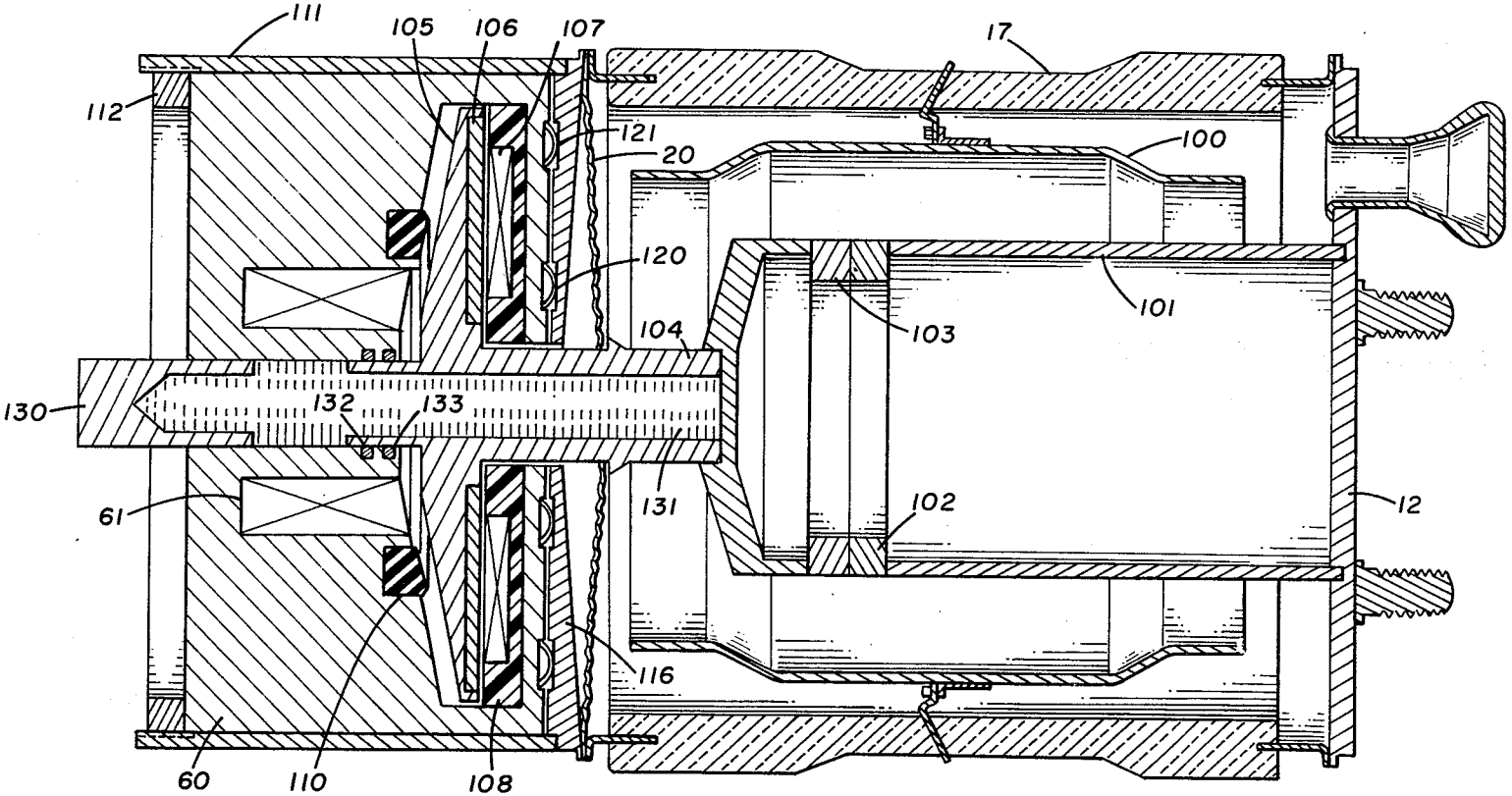
FIG. 3 is a cross-sectional view of a third embodiment of the invention.

FIG. 3 shows a third embodiment of the invention which includes a novel connection from the movable contact to a stationary terminal, and a novel means for maintaining contact pressure, even though there is contact erosion as noted above. In FIG. 3 all components which are similar in function to those of FIGS. 1 and 2 have similar identifying numerals.

In FIG. 3, shield 100 is supported from the center of the insulation envelope 17. A large diameter stationary contact tube 101 is provided which has a large area ring contact 102 which cooperates with movable large area ring contact 103. Ring contact 103 is then connected to the movable conductive stem 104 which may be integral with steel plate 105. Plate 105 carries a highly conductive counterplate 106 which cooperates with the Lenz coil 107. The Lenz coil 107 is then contained in the insulation body 108 which is fixed within the core 60. The core 60 receives a winding 61 of the type shown in FIG. 1, and further contains a shock-absorbing ring 110 in place of the central shock-absorbing pad 65 of FIG. 1.

Core 60 is mounted to be capable of slight axial movement within the cylinder 111 and is pressed against ring 112 which is threaded into the interior end of cylinder 111. The right-hand end surface of core 60 is fitted with disk-type springs 120 and 121 which press against the modified end plate 116 of the vacuum assembly. Thus, the mass 60 is essentially spring-supported within the cylinder 111.

Electrical connection from the movable contact 103 to the protruding terminal stud 130 in FIG. 3 is made through a suitable liquid metal 131 which fills the hollow interior of the stud 104 and extends through a central opening in body 60 to the conductive member 130. Suitable O-ring seals 132 and 133 prevent the escape of the liquid metal material 131.

The use of the liquid metal 131 replaces the conductive members **43*a* and 43*b* in FIGS. 1 and 2** as the current transfer means for transferring current from the movable contact to an external terminal.

The arrangement of FIG. 3 permits automatic adjustment of the relative position of movable contact 103 relative to stationary contact 102 due to contact erosion while permitting tight coupling between Lenz coil 107 and its counterplate 106 in the contact closed position.

The disk springs 120 and 121 pressing the mass 60 against stop 112 will allow limited adjustment of the position of mass 60 and contact 103 when the contacts are closed in order to assure proper contact pressure. Contact closing force is caused by atmospheric pressure on diaphragm 20 in order to maintain the device closed. Note that the force of the disk springs 120 and 121 will be less than the atmospheric force exerted on the diaphragm 20. Under impulse acceleration, the Lenz coil 108 will cause high-speed operation of the counterplate 106, largely independent of mass 60, and most energy in the system will be transferred to the movable mass including counterplate 106, contact stem 104 and contact 103 to cause the desired high opening speed.

In order to have an extremely high opening speed, it is, of course, desirable that the movable mass be as small as possible. The use of the liquid metal transfer means 131 will cause little increase in the movable mass as compared to the use of the flexible transfer conductors **43*a* and 43*b* of FIG. 1**.

Although preferred embodiments of this invention have been described, many variations and modifications will now be apparent to those skilled in the art, and it is preferred therefore that the instant invention be limited not by the specific disclosure herein but only by the appended claims.

I claim:

1. A high speed circuit interrupter comprising:

a pair of cooperable contacts;

an evacuated housing enclosing said pair of cooperable contacts and having an axis;

flexible contact support means for supporting one of said pair of contacts for movement along said axis of said housing and for forming a vacuum seal for said housing; the other of said contacts being secured to said housing and being immovable relative thereto; and a Lenz coil fixed to the exterior of said housing and a conductive counterplate disposed outside said housing and closely coupled to said Lenz coil and fixed to said one of said pair of contacts, said Lenz coil being adapted to produce a strong repulsive force on said counterplate to move said counterplate and said one of said contacts away from said other of said pair of cooperable contacts, thereby to interrupt a current that is flowing through said pair of contacts; and said interrupter including no means for moving said one of said pair of contacts to interrupt a current that is flowing through said pair of contacts other than said Lenz coil and said counterplate.

2. The device of claim 1 which further includes latch means secured to the exterior of said housing and adapted to latch said counterplate in an open position when said counterplate is moved due to the energization of said Lenz coil.

3. The device of claim 2 wherein said counterplate consists of a highly conductive material which is fixed to a coextensive steel reinforcing plate.

4. The device of claim 1 wherein said counterplate consists of a highly conductive material which is fixed to a coextensive steel reinforcing plate which provides mechanical support for said highly conductive material.

5. The device of claim 3 wherein said steel reinforcing plate is disposed on the side of said counterplate which faces away from said Lenz coil.

6. The device of claim 5 wherein said one of said contacts and said counterplate have a total movement in one direction of about 5 millimeters.

7. The device of claim 1 wherein said one of said contacts and said counterplate have a total movement in one direction of about 5 millimeters.

8. The device of claim 7 wherein said flexible contact support means comprises a metal diaphragm.

9. The device of claim 7 wherein said flexible contact support means comprises a short welded metal bellows.

10. The device of claim 1 wherein said housing, said Lenz coil, said flexible contact support means, and said counterplate are coaxial.

11. The device of claim 1 which further includes means for applying pressure greater than the pressure within said housing to the exterior of said counterplate for reclosing said pair of contacts.

12. The device of claim 1 wherein one surface of said Lenz coil has a small axial spacing relative to said counterplate when said pair of contacts are in contact with each other such that it is possible to maintain said pair of contacts in good electrical contact with each other when said contacts are in their closed position, even if there is contact erosion.

13. The device of claim 1 which further includes first and second device terminals connected, respectively, to each contact of said pair of cooperable contacts and conductive means for electrically connecting said one of said pair of contacts to its said respective terminal.

14. The device of claim 13 wherein said conductive means consists of a flexible conductor.

15. The device of claim 13 wherein said conductive means consists of a liquid metal.

16. The device of claim 1 which further includes a spring supported mass distinct from said flexible contact support means and receiving said counterplate; said Lenz coil being fixed to said spring supported mass, and said spring supported mass being biased in a direction to move said counterplate and said one of said pair of contacts in a first direction to cause engagement between said pair of contacts; said counterplate and said one of said pair of contacts being movable in a direction opposite to said first direction independently of said spring supported mass.

* * * * *